US006334319B1

(12) United States Patent
Senner

(10) Patent No.: US 6,334,319 B1
(45) Date of Patent: Jan. 1, 2002

(54) ICE LEVEL SENSING ASSEMBLY

(75) Inventor: Kurt C. Senner, Galesburg, IL (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/690,850

(22) Filed: Oct. 18, 2000

(51) Int. Cl.[7] ..... F25C 1/00
(52) U.S. Cl. ..... 62/137; 62/344
(58) Field of Search ..... 62/137, 139, 344

(56) References Cited

U.S. PATENT DOCUMENTS

| | | | | |
|---|---|---|---|---|
| 2,717,500 | A | | 9/1955 | Ploeger |
| 2,799,144 | A | | 7/1957 | Barton |
| 2,955,442 | A | | 10/1960 | Loewenthal |
| 2,970,453 | A | | 2/1961 | Harle et al. |
| 2,976,697 | A | | 3/1961 | Dahl |
| 3,005,322 | A | | 10/1961 | Harle |
| 3,048,023 | A | | 8/1962 | Taylor |
| 3,163,017 | A | | 12/1964 | Baker et al. |
| 3,290,892 | A | | 12/1966 | Roedter |
| 3,545,217 | A | | 12/1970 | Linstromberg |
| 3,581,516 | A | | 6/1971 | Buchser et al. |
| 3,885,400 | A | | 5/1975 | Webb |
| 3,964,269 | A | | 6/1976 | Linstromberg |
| 4,095,439 | A | | 6/1978 | Linstromberg |
| 4,098,094 | A | | 7/1978 | Linstromberg |
| 4,100,761 | A | | 7/1978 | Linstromberg et al. |
| 4,269,039 | A | | 5/1981 | Baker |
| 4,610,147 | A | | 9/1986 | Kawasumi |
| 4,665,708 | A | * | 5/1987 | Tate, Jr. et al. ..... 62/344 |
| 4,835,978 | A | * | 6/1989 | Cole ..... 62/137 |
| 4,872,318 | A | | 10/1989 | Klemmensen |
| 4,947,652 | A | | 8/1990 | Arcangeli |
| 5,119,639 | A | | 6/1992 | Bein et al. |
| RE34,174 | E | * | 2/1993 | Brown et al. ..... 62/137 |
| 5,460,007 | A | | 10/1995 | Reed et al. |
| 5,596,182 | A | * | 1/1997 | Edwards et al. ..... 62/137 |
| 5,619,858 | A | | 4/1997 | Gunderson et al. |
| 5,768,899 | A | | 6/1998 | Lee et al. |
| 5,768,900 | A | | 6/1998 | Lee et al. ..... |

* cited by examiner

*Primary Examiner*—William E. Tapolcai
*Assistant Examiner*—Mohammad M Ali
(74) *Attorney, Agent, or Firm*—Diederiks & Whitelaw, PLC

(57) ABSTRACT

An assembly for sensing a level of ice stored in a bin of an automatic ice maker includes a bale arm and a sensing member. The sensing member is rotatably attached to the bale arm for movement between multiple, varying height positions. The sensing member includes first, second and third portions, with the first portion including a first pair of spaced leg elements, the second portion of the sensing member including a second pair of spaced leg elements, and the third portion of the sensing member being constituted by a vortex leg portion which interconnects the second pair of spaced leg elements. The first leg elements include connecting portions which are snap-fittingly attached to the bale arm, while being biased into engagement with portions of the bale arm. At least one of the connecting portions is formed with detents into which a segment of bale arm projects in order to establish a selected one of the varying height positions.

20 Claims, 5 Drawing Sheets

ICE LEVEL SENSING ASSEMBLY

BACKGROUND OF THE INVENTION

1. Field of the Invention

The present invention pertains to the art of refrigerators and, more particularly, to an assembly for adjustably sensing the level of ice collected within a storage bin of an automatic ice maker system.

2. Discussion of the Prior Art

In the art of refrigerators, it is widely known to incorporate an automatic ice maker system wherein ice cubes are formed and collected within a storage bin from which the cubes can be accessed either manually or through a dispenser. With such a system, provisions are commonly made to sense the level of ice cubes within the storage bin and to automatically terminate the formation of additional ice cubes until the level falls below a certain height. Typically, the automatic ice maker will have an associated bale arm which is raised and lowered based on the level of the ice in the storage bin. When the bale arm is shifted upward a predetermined distance, the formation of ice will be temporarily terminated. With this arrangement, it is not possible for the consumer to personally establish a desired ice level height.

To address this potential drawback, it has heretofore been proposed to attach an additional ice level sensing element to the bale arm, with the sensing element being adjustable in order to enable the storage level of the ice to be selectively altered. An example of such an arrangement is disclosed in U.S. Pat. No. 5,619,858. In general, this patented arrangement enables one of two different ice levels to be selected. Not only is this prior art assembly limited in its range of adjustability, but the manner in which the sensing element is adjusted is considered somewhat cumbersome and time consuming, particularly given the fact that only a small zone is typically available about the element to manually grasp and adjust the element. In addition, when it is desired to withdraw the ice storage bin from the freezer compartment, the sensing element can actually obstruct the movement of the bin.

Based on the above, there exists a need in the art for an ice level sensing assembly including a sensing member which can be adjusted through a wide range in order to enhance the versatility, efficiency and effectiveness of an overall automatic ice maker assembly. Furthermore, there exists a need for an adjustable ice level sensing assembly which is designed to enable removal and replacement of the ice storage bin from the freezer compartment without the need to manually alter the selected position of the sensing member.

SUMMARY OF THE INVENTION

The present invention is directed to an automatic ice maker system including an arm assembly used to sense and adjust the amount of ice stored in an ice bin in order to control the production of additional ice. More specifically, the invention is directed to attaching a sensing member to a bale arm of an automatic ice maker, with the positioning of the sensing member relative to the bale arm being easily adjustable in order to enable a consumer to readily select and change the amount of stored ice. The ice level sensing member is uniquely shaped to allow from about 50–100% of the maximum capacity of the ice maker bin to be maintained. In addition, the shape of the ice level sensing member allows the storage bin to be removed and replaced from within a freezer compartment by the consumer without moving the bale arm or the sensing member out of the way or separately turning the ice maker off.

In accordance with a preferred embodiment of the invention, the sensing member has two upper end connectors which are adapted to snap-fittingly receive a crosspiece portion of the bale arm, with the end connectors being generally biased outward to positively engage generally parallel leg portions of the bale arm. One of the end connectors is formed with arcuately spaced detents defined by recesses arranged between various projections. In the most preferred form of the invention, three such detents are provided to selectively receive a respective bale arm leg portion. These detents enable the adjustment of the element to alter the maximum capacity of the storage bin. From the end portions, the sensing element has sections which extend in three intersecting planes, while converging to a central vortex portion. The sections generally bend back upon themselves and are angled to enhance capacity adjustments and to enable the storage bin to be removed from and replaced within the freezer compartment without manually moving the bale arm out of the way.

Additional objects, features and advantages of the invention will become more readily apparent from the following detailed description of a preferred embodiment thereof when taken in conjunction with the drawings wherein like reference numerals refer to corresponding parts in the several views.

DETAILED DESCRIPTION OF THE PREFERRED EMBODIMENT

Figure 1:
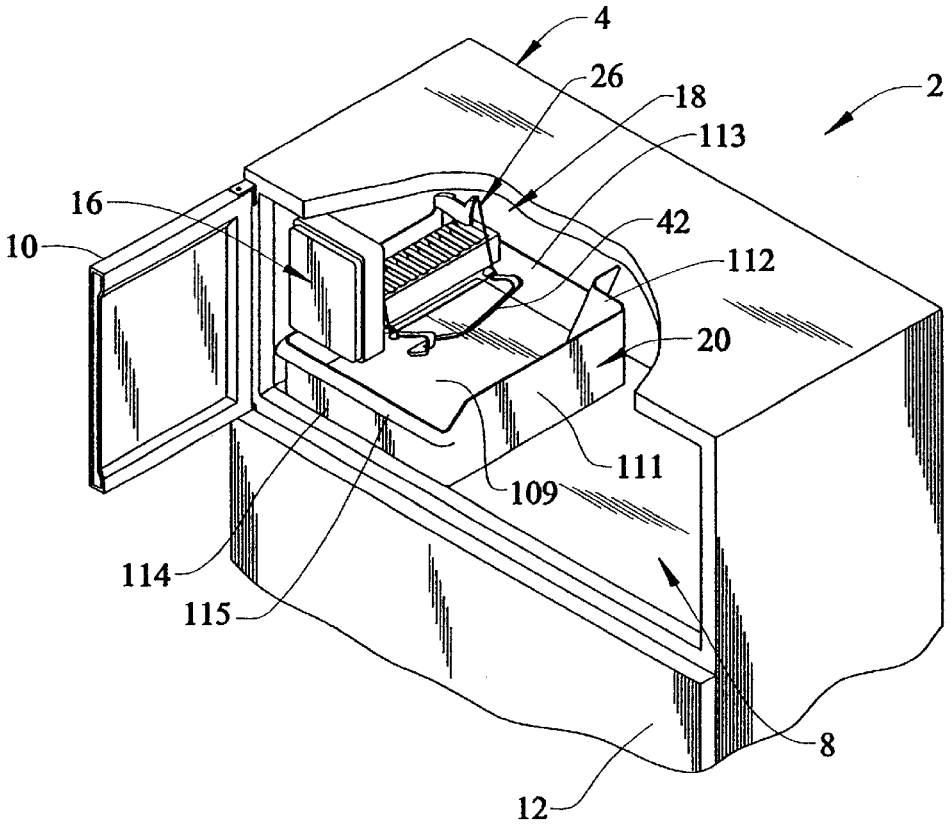
FIG. 1 is a perspective view depicting the adjustable ice level sensing assembly of the invention within an upper freezer compartment portion of a refrigerator.
Figure 2:
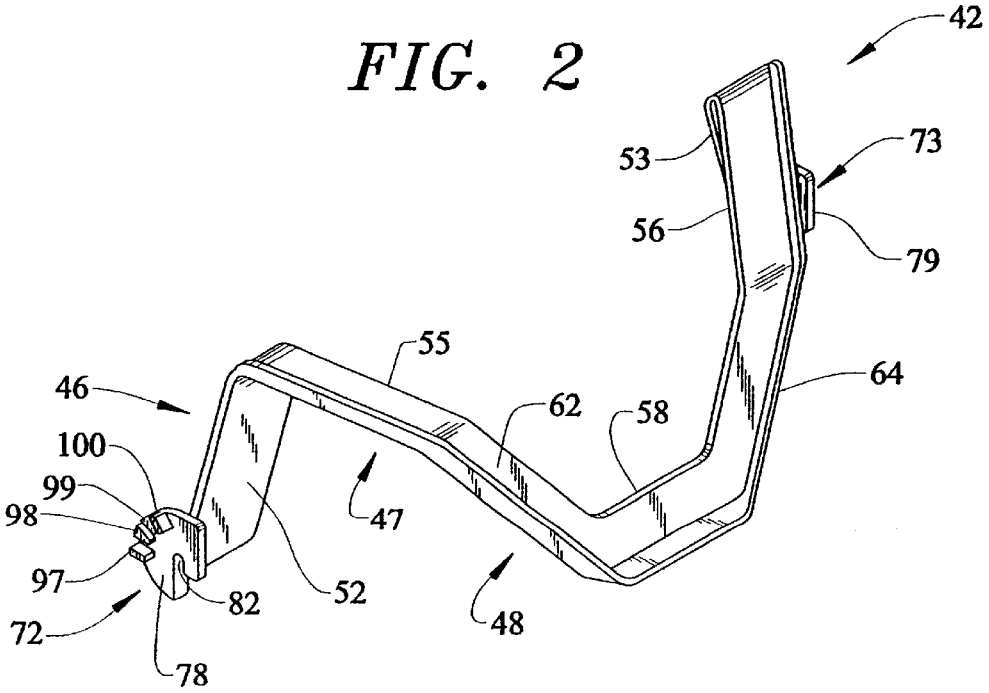
FIG. 2 is a perspective view of the sensing member incorporated in adjustable ice level assembly of the invention.
Figure 3:
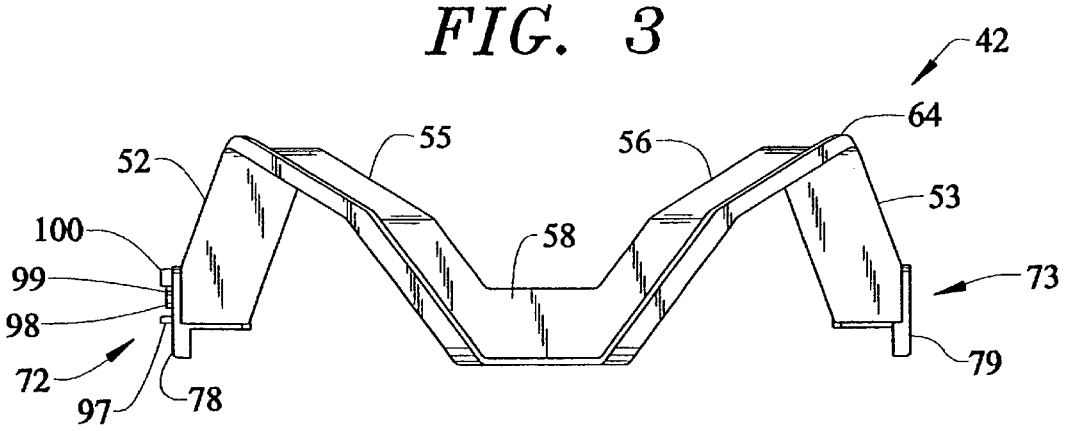
FIG. 3 is a right side elevational view of the sensing member of FIG. 2.
Figure 4:
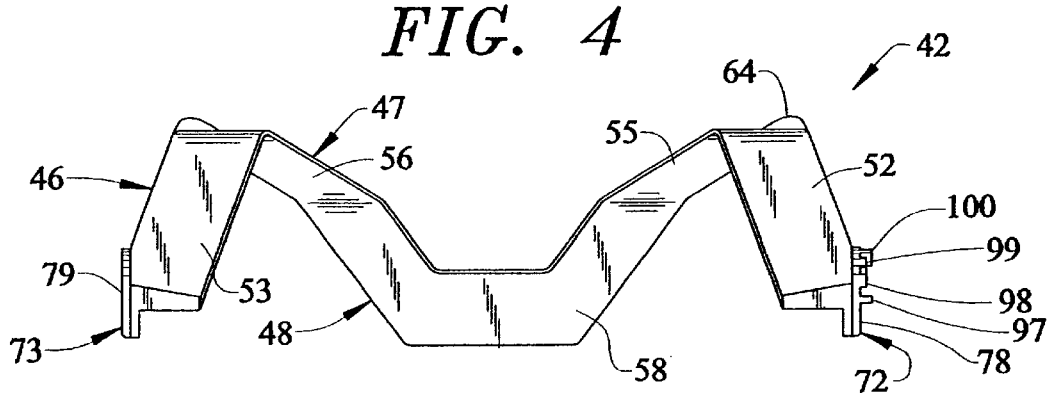
FIG. 4 is a left side elevational view of the sensing member.
Figure 5:
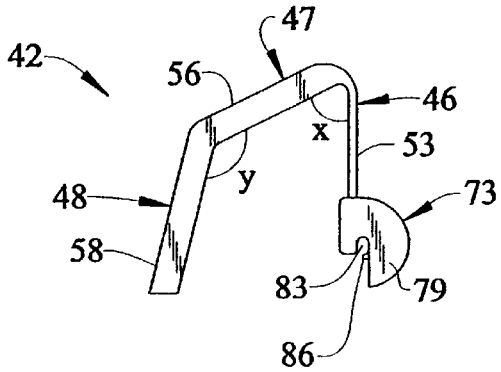
FIG. 5 is a rear elevational view of the sensing member.
Figure 6:
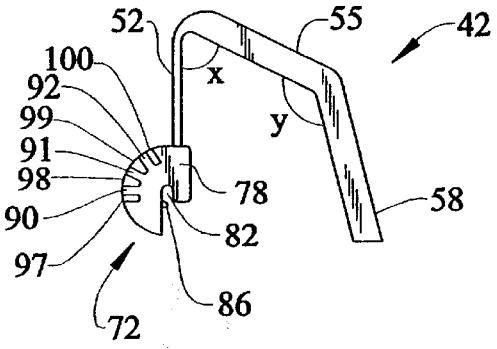
FIG. 6 is a front elevational view of the sensing member.
Figure 7:
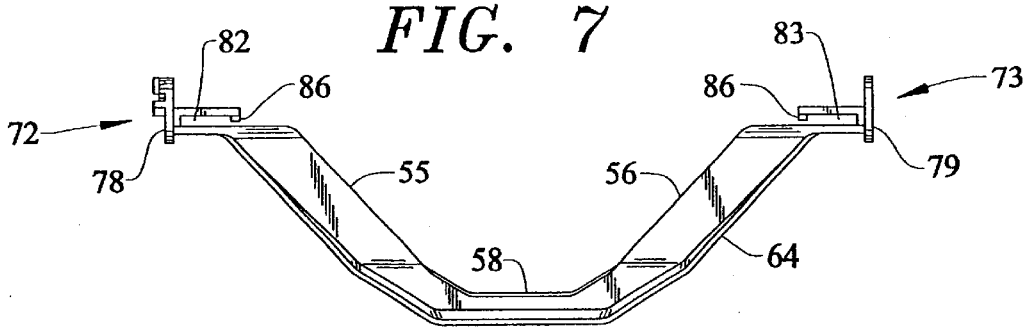
FIG. 7 is top view of the sensing member.
Figure 8:
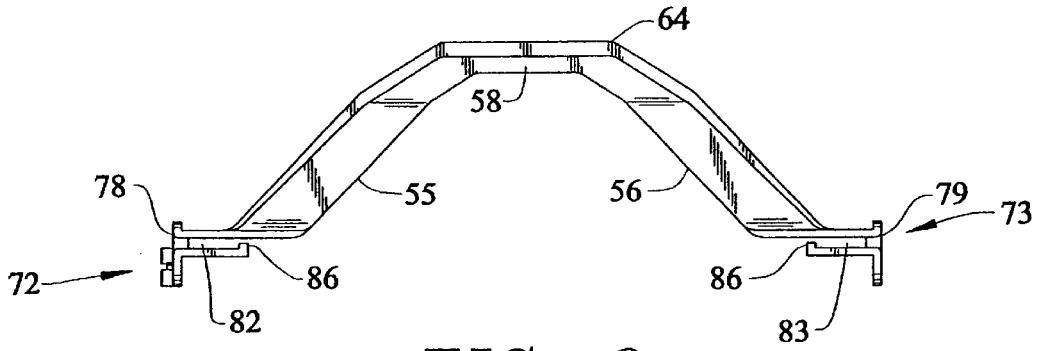
FIG. 8 is a bottom view of the sensing member.
Figure 9:
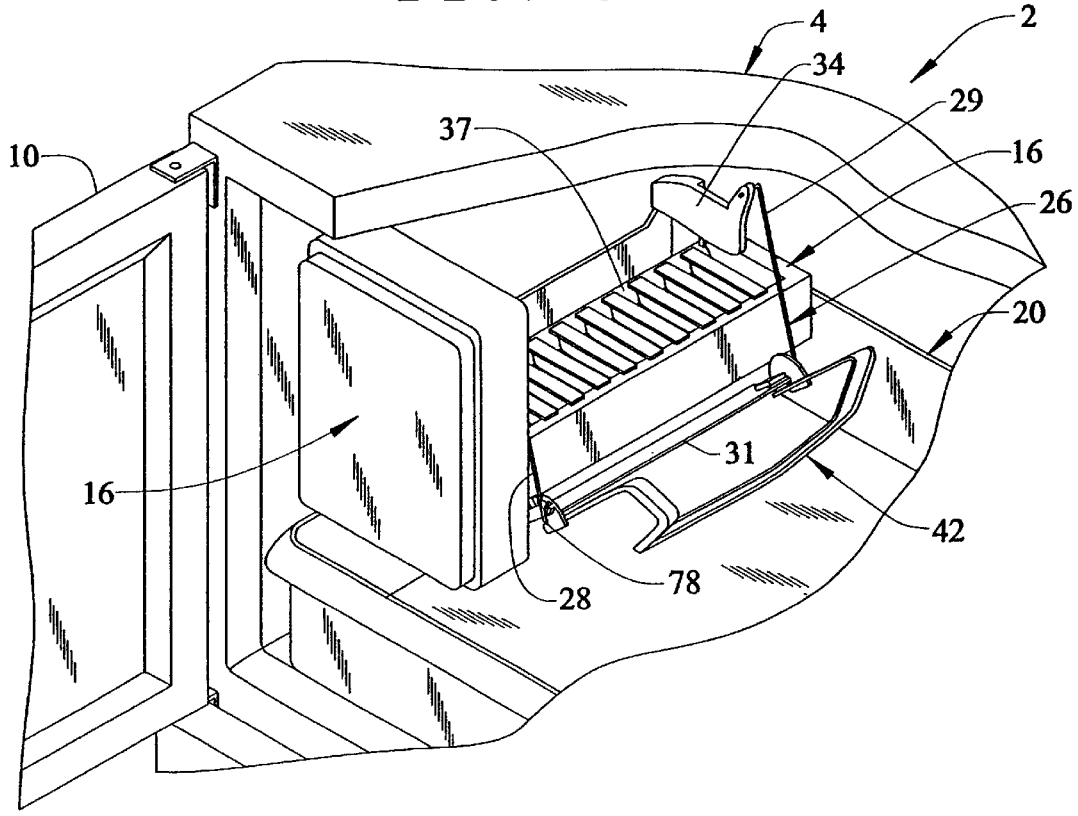
FIG. 9 is an enlarged, partial cross-sectional perspective view illustrating the adjustable ice level sensing assembly of the invention.
Figure 10:
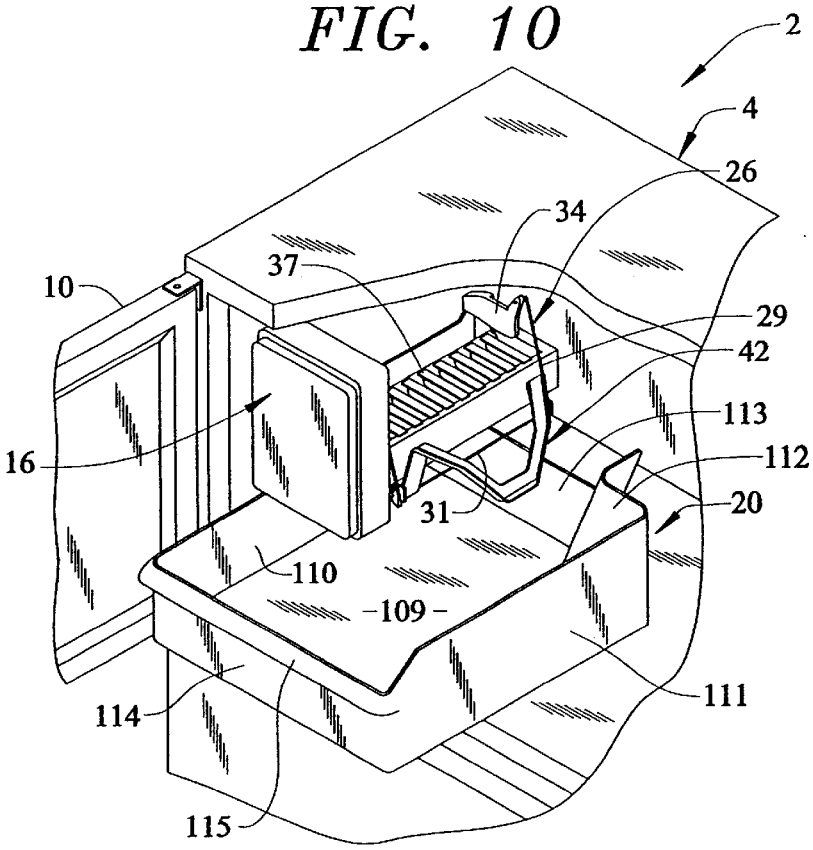
FIG. 10 illustrates the ice level sensing assembly with the sensing member placed in an upper or maximum ice capacity condition and with the ice storage bin in a partially retracted position.
Figure 11:
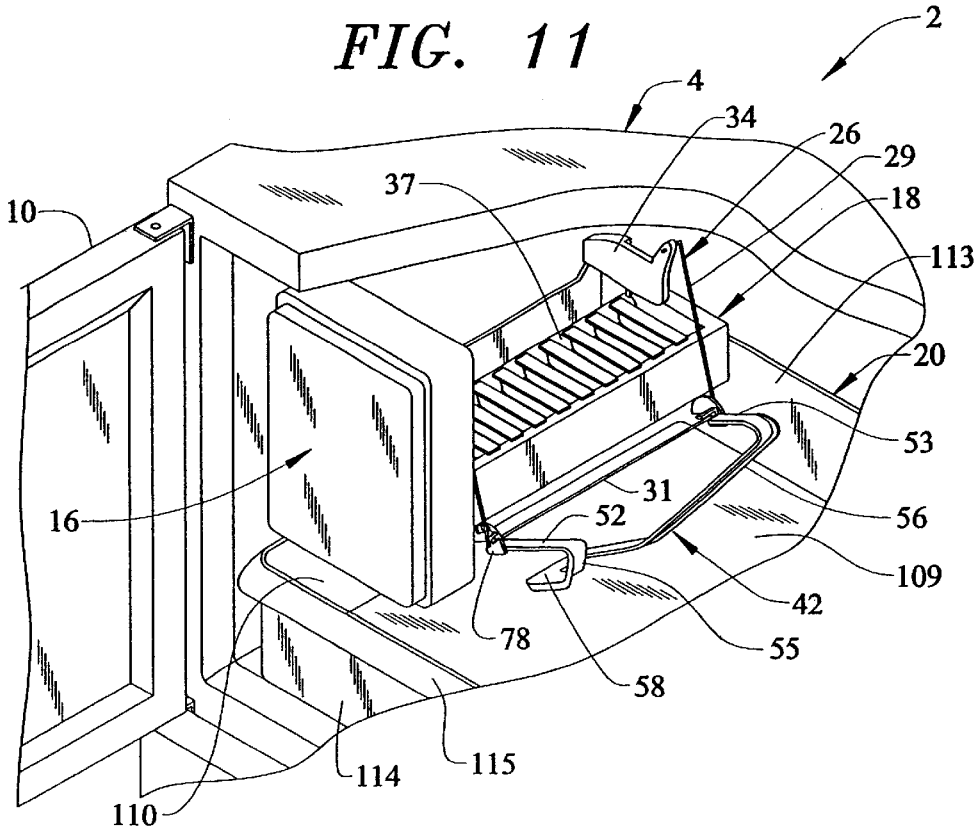
FIG. 11 illustrates the sensing member in a lower or reduced ice capacity condition.

With initial reference to FIGS. 1 and 9–11, a refrigerator generally indicated at 2 includes a cabinet 4 within which is defined a freezer compartment 8. Freezer compartment 8 can be selectively accessed through the pivoting of freezer door 10. Also provided is a fresh food door 12 which enables access to a fresh food compartment (not shown). As shown, refrigerator 2 constitutes a top-mount style unit. However, as will become fully evident below, the present invention is equally applicable to various types of refrigerators, including side-by-side style units.

Arranged within freezer compartment 8 is an ice maker assembly 16. In a manner known in the art, ice maker assembly 16 includes an ice maker unit 18 and an ice storage bin 20. Ice maker unit 18 is shown to include a bale arm 26 including a pair of fore-to-aft spaced and generally parallel leg portions 28 and 29 which are interconnected by a cross leg portion 31. Leg portion 29 is shown to be connected to a switch arm 34.

Ice maker unit 18 also includes an ice mold 37. In general, this construction, as well as the operation, of ice maker unit 18 is known in the art. Basically, the flow of water is directed to ice mold 37 to fill up various cavities thereof in order to produce ice cubes which are deposited into storage bin 20. In a typical ice maker arrangement, when the storage bin has collected sufficient number of ice cubes, the stored ice cubes will act on the bale arm to cause the arm to be lifted which, in turn, operates on the switch arm to de-activate the ice maker unit. The bale arm and/or switch arm are preferably biased downward to an ice making position such that, when a sufficient number of ice cubes are removed from storage bin 20, the ice maker unit will be automatically reactivated.

The present invention is particularly directed to the incorporation of sensing member 42 in ice maker assembly 16. As will be detailed more fully below, sensing member 42 is adjustably connected to and projects from bale arm 26. Sensing member 42 is adapted to be used to enable a consumer to readily select and change the amount of stored ice within storage bin 20 and is uniquely shaped to allow from about 50%–100% of the maximum capacity of storage bin 20 to be maintained. Furthermore, sensing member 42 is shaped in a manner which allows storage bin 20 to be removed and replaced from within freezer compartment 8 by the consumer without having to manually move bale arm 26 or sensing member 42 out of the way. Reference will now be made to FIGS. 2–8 in describing the preferred construction of sensing member 42.

In general, sensing member 42 includes first, second and third portions 46–48. First portion 46 is defined by a pair of leg elements 52 and 53, second portion 47 extends from first portion 46 and is defined by a second pair of leg elements 55 and 56 and third portion 48 is defined by a vortex leg portion 58 that interconnects the second pair of leg elements 55 and 56. In general, each of leg elements 52, 53, 55, 56 and leg portion 58 is defined by a widened plate portion 62. In addition, the second pair of leg elements 55, 56, as well as vortex leg portion 58, preferably includes an upstanding peripheral wall 64.

In the most preferred form of the invention, the entire sensing member 42 is molded of plastic, with plate portions 62 generally being in the order of ⅛" (0.32 cm) thick and 13"–16" (33–40.6 cm) wide. Of course, these measurements are only presented for the preferred embodiment and can widely vary without departing from the spirit of the invention. As clearly shown, leg elements 55 and 56 project at an acute angle x from leg elements 52 and 53 respectively. In general, leg elements 52 and 53 extend upwardly to some extent from cross leg portion 31 of bale arm 26, while leg elements 55 and 56 project downwardly at the acute angle from leg elements 52 and 53. On the other hand, vortex leg portion 58 extends downwardly at an obtuse angle y from leg elements 55 and 56. Therefore, sensing member 42 includes portions which extend in three intersecting planes. More specifically, the first pair of leg elements 52 and 53 extend in a first plane, the second pair of leg elements 55 and 56 extend in a second plane and vortex leg portion 58 extends in a third plane, with these planes intersecting one another. At this point, it should be noted that, although first and second portions 46 and 47 are formed from respective spaced leg elements 52, 53 and 55, 56, it should be noted that these portions 46 and 47 could be interconnected other than through vortex leg portion 58. Separate leg elements are preferably utilized to minimize material as vortex leg portion 58 is actually adapted to engage the ice cubes within storage bin 20 as will be detailed more fully below.

The first pair of leg elements 52 and 53 have associated therewith first and second end connectors 72 and 73 respectively. Each end connector 72, 73 has an associated face portion 78, 79 and also includes structure for fixing sensing member 42 to bale arm 26. In the preferred embodiment, this fixing structure takes the form of respective channels 82 and 83 as clearly depicted in these figures. At the inward ends of each channel 82, 83, sensing member 42 is formed with a nub 86 which projects into the respective channel 82, 83. With this arrangement, cross leg portion 31 of bale arm 26 is received within channels 82 and 83, while leg portions 28 and 29 of bale arm 26 extend along face portion 78 and 79 respectively. Sensing member 42 is attached to bale arm 26 by both the presence of nubs 86 which establish a snap-fitting connection for sensing member 42 to bale arm 26 by minimizing the cross sectional opening associated with channels 82 and 83, as well as the fact that the distance between face portions 78 and 79, as compared to the distance between leg portions 28 and 29, cause leg portions 28 and 29 to be biased against face portions 78 and 79. The biasing function associated with this overall fixing structure will be further highlighted below.

As indicated above, it is desirable to enable easy adjustment of sensing member 42 to establish varying height positions in order to allow from about 50%–100% of the maximum capacity of storage bin 20 to be selectively maintained. To perform this function in accordance with the most preferred embodiment of the invention, face portion 78 is formed with a plurality of detents 90–93. More specifically, projecting from face portion 78 are various arcuately spaced projections 97–100. Detent 90 is defined between projections 97 and 98, detent 91 is defined between projections 98 and 99 and detent 92 is defined between projections 99 and 100. In the most preferred embodiment, projections 97 and 100 extend from face portion 78 a distance greater than projections 98 and 99. For instance, projections 98 and 99 can extend about 1/16" (0.16 cm) from face portion 78, while projections 97 and 100 extend about ⅛" (0.32 cm).

Figure 12:
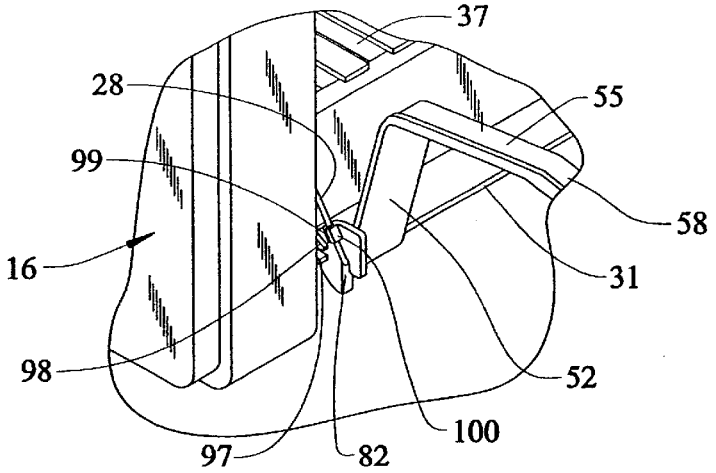
FIG. 12 is an enlarged partial view showing the sensing member fully raised.
Figure 13:
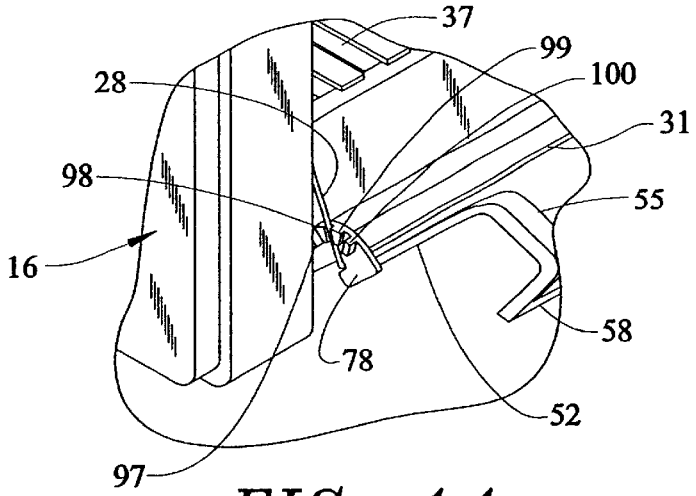
FIG. 13 depicts the sensing member in an intermediate position.
Figure 14:
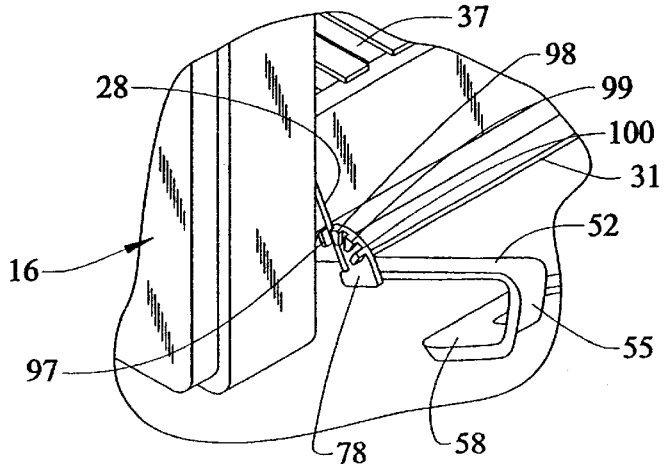
FIG. 14 illustrates the sensing member in a fully lowered position.

With this configuration, leg portion 28 of bale arm 26 can be received in a selected one of detents 90–92 in order to establish a desired height for sensing member 42 and, correspondingly, a desired ice level capacity retained within storage bin 20. FIG. 12 illustrates sensing member 42 in a high capacity position wherein leg portion 28 is arranged between projections 100 and 99; FIG. 13 shows sensing member in a 75% capacity position wherein sensing member 42 has been rotated about an axis defined by cross leg portion 31 until leg portion 28 of bale arm 26 extends over projection 99 and is received within detent 91 between projections 98 and 99. Since face portions 78 and 79 are spaced such that these portions abut leg portions 28 and 29, it should be realized that leg elements 52 and 53 shift toward one another as leg portion 28 extends over projection 99. Leg elements 52 and 53 then shift away from each other so that leg portion 28 is received within detent 91. FIG. 14 shows sensing member 42 in a lower capacity position which is established, in the preferred embodiment, at 50% ice storage for bin 20. Here, leg portion 28 is received within detent 90 between projections 97 and 98.

In each of the various positions shown in FIGS. 12–14, ice within storage bin 20 can engage vortex leg portion 58 such that, as the ice level builds within storage bin 20, bale arm 26 can be shifted to cause ice maker unit 18 to cease producing further ice cubes until the level of ice cubes in the storage bin 20 is reduced. When in the maximum capacity position shown in FIG. 12, the lowermost portion of sensing member 42 is substantially at the level of cross leg portion 31 of bale arm 26. However, at each of the positions shown in FIGS. 13 and 14, vortex leg portion 58 extends below cross leg portion 31. When in either of these lowered positions, the presence of sensing member 42 would be capable of interfering with the removal of storage bin 20 from freezer compartment 8. However, given that sensing member 42 converges from end connectors 72 and 73 towards vortex leg portion 58, the upstanding peripheral wall 64 of leg elements 55 and 56 and vortex leg portion 58 function as a camming surface which cooperates with storage bin 20. That is, when storage bin 20 is shifted from the recessed position shown in FIG. 1 to the partially withdrawn position shown in FIG. 10, sensing member 42 is cammed upwardly to cause rotation of bale arm 26.

More specifically, in the most preferred embodiment, storage bin 20 includes a bottom 109, side walls 110 and 111, a rear comer wall portion 112, a lower rear wall section 113 and a lower front wall section 114. As storage bin 20 is shifted out of freezer compartment 8 through the use of front, molded-in handle 115, lower rear wall section 113 cams along the upstanding peripheral wall 64 of leg element 56 and/or vortex leg portion 58 depending upon the height established for sensing member 42. Therefore, without manually adjusting sensing member 42, storage bin 20 can be removed from freezer compartment 8 while causing an automatic rotation of bale arm 26. A similar action can occur when bale arm 26 is in a lowered condition and storage bin 20 is being inserted into freezer compartment 8 wherein lower rear wall section 113 of storage bin 20 will engage upstanding peripheral wall 64 of leg element 55 and/or vortex leg portion 58.

Although described with respect to a preferred embodiment of the invention, it should be readily understood that various changes and/or modifications can be made to the invention without departing from the spirit thereof. For example, although the invention has been described to provide three varying height positions for the sensing member relative to the bale arm, it should be recognized that additional detents or other indexing structure could be provided to enable further positions. In fact, the frictional engagement between face portion 78 and 79 and leg portions 28 and 29 could be such that a substantially infinite number of positions could be established without departing from the invention. In any case, it should be recognized that the incorporation of sensing member 42 enables a wide range of adjustments in the amount of ice maintained in storage bin 20 and the particular configuration of sensing member 42 adds to the versatility and effectiveness of the overall ice maker assembly 16. Regardless, when considering the overall invention, the invention should only be limited by the scope of the following claims.

I claim:

1. In a refrigerator freezer including an automatic ice maker incorporating a bale arm movable between raised and lowered positions for controlling a production of ice cubes, a device for repositioning the bale arm based on a selected level of the ice cubes collected within a storage bin comprising:

a sensing member including an elongated body attached to the bale arm for movement about a rotational axis relative to the bale arm; and means for fixing the sensing member, at different angular positions about the rotational axis, relative to the bale arm in a selected one of at least three, varying height positions.

2. The device according to claim 1, wherein the bale arm includes a pair of spaced leg portions, said sensing member being biased into engagement with said spaced leg portions.

3. The device according to claim 2, wherein the sensing member includes a pair of spaced end connectors having respective face portions, with each of said face portions engaging a respective one of said spaced leg portions of the bale arm.

4. The device according to claim 3, wherein said fixing means includes a plurality of detents formed on one of said face portions, said respective one of said spaced leg portions being received in one of said detents to establish a desired one of the varying height positions.

5. The device according to claim 3, wherein the bale arm includes a cross leg portion which interconnects the spaced leg portions and each of the end connectors includes an elongated channel which snap-fittingly receives the cross leg portions of the bale arm.

6. A device for sensing a level of ice cubes produced by an ice maker and collected within a storage bin comprising;

a bale arm rotatably attached to the ice maker for movement between raised and lowered positions for controlling a production of ice cubes; and a sensing member including a connecting portion rotatably, adjustably attached to the bale arm, a first portion projecting in a first direction from the connecting portion, a second portion extending at a first angle from the first portion and a third portion extending from the second portion at a second angle.

7. The device according to claim 6, wherein the first, second and third portions extend within first, second and third intersecting planes respectively.

8. The device according to claim 6, wherein the first angle is different from the second angle.

9. The device according to claim 8, wherein the first angle constitutes an acute angle.

10. The device according to claim 9, wherein the second angle is an obtuse angle.

11. The device according to claim 6, wherein the first portion of the sensing member includes a first pair of spaced leg elements, the second portion of the sensing member includes a second pair of spaced leg elements, and the third portion of the sensing member is constituted by a vortex leg portion which interconnects the second pair of spaced leg elements.

12. A device for sensing a level of ice cubes produced by an ice maker and collected within a storage bin comprising;

a bale arm rotatably attached to the ice maker for movement between raised and lowered positions for controlling a production of the ice cubes; and a sensing member adjustably attached to the bale arm, said sensing member including first, second and third portions extending in respective, intersecting planes.

13. The device according to claim 12, wherein at least a first pair of the planes intersect at an acute angle, while a second pair of the planes intersect at an obtuse angle.

14. The device according to claim 13, wherein the first portion of the sensing member projects in a first plane, the second portion of the sensing member is connected to the first portion and extends in a second plane and the third portion extends from the second portion in a third plane.

15. The device according to claim 14, wherein the first portion of the sensing member is rotatably attached to the bale arm.

16. The device according to claim 15, wherein the first portion projects upward from the bale arm.

17. The device according to claim 16, wherein the second portion projects downward from the second portion.

18. The device according to claim 17, wherein the first portion of the sensing member includes a first pair of spaced leg elements, the second portion of the sensing member includes a second pair of spaced leg elements, and the third portion of the sensing member is constituted by a vortex leg portion which interconnects the second pair of spaced leg elements.

19. The device according to claim 12, further comprising:

means for fixing the sensing member in a desired position relative to the bale arm.

20. The device according to claim 19, wherein said fixing means includes a plurality of detents, said bale arm being adapted to be selectively received in a respective one of said detents.

* * * * *